US006884000B2

(12) United States Patent
Sovik

(10) Patent No.: US 6,884,000 B2
(45) Date of Patent: Apr. 26, 2005

(54) MATERIAL ALIGNMENT FOR COMPACTION

(75) Inventor: Robert A. Sovik, Clifton Park, NY (US)

(73) Assignee: TransTech Systems, Inc., Schenectady, NY (US)

( * ) Notice: Subject to any disclaimer, the term of this patent is extended or adjusted under 35 U.S.C. 154(b) by 31 days.

(21) Appl. No.: 10/641,437

(22) Filed: Aug. 15, 2003

(65) Prior Publication Data

US 2005/0036838 A1 Feb. 17, 2005

(51) Int. Cl.[7] ..... E01C 19/22; E01C 19/12
(52) U.S. Cl. ..... 404/118; 404/101
(58) Field of Search ..... 404/101, 102, 404/103, 113, 114, 118, 119, 120, 93, 96, 404/75, 81

(56) References Cited

U.S. PATENT DOCUMENTS 1,657,727 A * 1/1928 Stubbs ..... 404/113
2,306,124 A * 12/1942 Jackson ..... 404/114
2,306,125 A 12/1942 Jackson
2,685,236 A * 8/1954 Wisniewski ..... 264/31
3,422,731 A * 1/1969 Sebastian ..... 404/96
3,555,983 A * 1/1971 Swisher et al. ..... 404/114
3,850,541 A * 11/1974 Baillet et al. ..... 404/114
4,560,303 A 12/1985 Haug et al.
4,756,100 A 7/1988 Holden
4,930,935 A 6/1990 Quenzi et al.
5,213,442 A 5/1993 Sovik
6,106,192 A 8/2000 Hargis et al.

FOREIGN PATENT DOCUMENTS

JP 03206201 A * 9/1991

* cited by examiner

*Primary Examiner*—Robert E. Pezzuto
*Assistant Examiner*—Alexandra K. Pechhold
(74) *Attorney, Agent, or Firm*—Spencer K. Warnick; Hoffman, Warnick & D'Alessandro LLC

(57) ABSTRACT

A member, screed and method for realigning material and compacting. A material realigning member is provided including structure for moving at least a first portion of a depth of a quantity of material laterally from an initial position thereof and then at least a second portion of the depth of the quantity of material back towards the initial position. In this fashion, aggregate particles may be moved in three horizontal directions, e.g., a direction of travel by a roller waveform, and both lateral directions by the invention, to realign material and allow for improved compaction.

24 Claims, 5 Drawing Sheets

MATERIAL ALIGNMENT FOR COMPACTION

BACKGROUND OF THE INVENTION

1. Technical Field

The present invention relates generally to material compaction, and more particularly, to a member, screed and method for realigning material and compacting.

2. Related Art

During material compaction in, for example, an asphalt paving environment, it is always advantageous to attain a high compaction rate in as little time as possible. A high compaction rate insures pavement longevity and thus reduces costly repairs. Similarly, speed of attaining a high compaction rate reduces paving costs.

A conventional approach to paving is shown in FIGS. 1 and 2. As shown in FIG. 1, an initial step includes applying a screed 10 to a paving material 12 that is placed in front of screed 10, which moves in a direction of travel DT. Paving material 12 may be, for example, e.g., asphalt. Conventional screeds normally include a receiving member 14 and a horizontal member 16 coupled to receiving member 14 by a nose 18. Screed 10 controls the depth of a raw paving material mat 20 that exits therefrom, provides a partial compaction of paving material 12 at nose 18, and smoothes paving material 12 with some compaction as it passes under horizontal member 16. The primary compaction zone is at nose 18 of screed 10 as shown in FIG. 1.

A conventional second step, as shown in FIG. 2, includes rolling raw paving material mat 20 with a roller 22 to generate a rolled mat 24. FIG. 2 also shows a side-by-side comparison of paving material aggregate 30A exiting a screed and rolled paving material aggregate 30B. As rolling occurs, compaction of paving material 12A occurs via the weight of roller 22 and gravity in a vertical direction causing voids areas 32 to be filled with the aggregate 30B and asphalt binders 34. Prior to vertical compaction, however, roller 22 also moves paving material 12A in front of roller 22 in a substantially horizontal direction of travel that causes a waveform 36, thus moving aggregate 30A in a substantially horizontal direction and aiding realignment of aggregate 30B into a more compacted paving material 12B. This two-directional motion, substantially horizontal and vertical, increases the density of the paving material.

A shortcoming of the above approach is that target compaction rates, e.g., 94–96%, require many rolling passes, which reduces productivity and increases costs. Unfortunately, with the current art, further rolling does not guarantee reaching a target or uniform compaction rate.

One reason for this situation is that aggregate may still be vertically aligned because prior compaction by the screed and roller does not realign aggregate in other than the vertical direction and the one substantially horizontal direction of travel caused by waveform 36. For example, referring to FIG. 2, vertically overlapping aggregate particles 40A, 42A, one or more of which includes a substantial dimension in the direction of travel, may continue to vertically overlap after an initial rolling pass —see aggregate particles 40B, 42B. Where one or more of aggregate particles 40A, 42A includes a relatively minimal lateral dimension, movement in a lateral horizontal direction may eliminate the overlap and allow for greater compaction. Unfortunately, no conventional approaches address this possibility. Additional rolling provides minimal horizontal realignment in a direction of travel because the size of waveform 36 diminishes with higher density. Accordingly, additional rolling may never provide enough horizontal realignment to overcome the overlap, and may result in undesirable aggregate fracture. In some cases, vibratory screeds are used to vibrate in a vertical direction in the attempt to provide additional compaction. However, the compaction improvement provided by these screeds is also limited because the aggregate is not moved to re-align. Thus the aggregate would need to fracture to cause additional improved compaction.

In view of the foregoing, there is a need in the art for a way to provide an additional mechanism for paving material aggregate realignment so further compaction can be attained.

SUMMARY OF THE INVENTION

The invention provides a member, screed and method for realigning material and compacting. A material realigning member for use on a screed is provided. The member includes structure for moving at least a first portion of a depth of a quantity of material laterally from an initial position thereof and then at least a second portion of the depth of the quantity of material back towards the initial position. In this fashion, aggregate particles may be moved in three horizontal directions, e.g., a direction of travel by a roller waveform, and both lateral directions by the invention, to realign material and allow for improved compaction.

A first aspect is directed to a screed for compacting a depth of material, the screed comprising: a vertically compacting surface having a first end and a second end; and means, positioned at a location along the vertically compacting surface between the first end and the second end, for moving at least a first portion of the depth of a quantity of material laterally from an initial position thereof and then at least a second portion of the depth of the quantity of material back towards the initial position.

A second aspect is directed to a material realigning member for use on a material compacting screed having a first end and a second end, the material realigning member comprising: a plurality of elements extending substantially vertically from the material compacting screed for moving at least a first portion of a depth of a quantity of material laterally from an initial position thereof and then at least a second portion of the depth of the quantity of material back towards the initial position; and means for coupling the plurality of substantially parallel elements at a location between the first end and the second end.

A third aspect is directed to a method of compacting paving material using a screed having a first end and a second end, the method comprising the steps of: compacting the paving material in a substantially vertical direction; and simultaneously moving at least a first portion of a depth of a quantity of the paving material laterally from an initial position thereof and then at least a second portion of the depth of the quantity of the paving material back towards the initial position.

A fourth aspect of the invention is directed to a method of increasing compaction capability of a screed, the method comprising the steps of: providing a screed having a vertically compacting surface having a first end and a second end; and coupling a material realigning member to the screed at a location along the vertically compacting surface between the first end and the second end for moving at least a first portion of a depth of a quantity of the paving material laterally from an initial position thereof and at least a second portion of the depth of the quantity of the paving material back towards the initial position.

The foregoing and other features of the invention will be apparent from the following more particular description of embodiments of the invention.

BRIEF DESCRIPTION OF THE DRAWINGS

The embodiments of this invention will be described in detail, with reference to the following figures, wherein like designations denote like elements, and wherein.

DETAILED DESCRIPTION OF THE INVENTION

The invention will now be described relative to an asphalt paving environment. It should be recognized that other application environments of the invention are also possible. In this regard, "paving material" shall include all varieties of asphalt, cement, concrete, soil, sand, stones, bituminous material and all other forms of in-place material that may be compacted.

Figure 3:
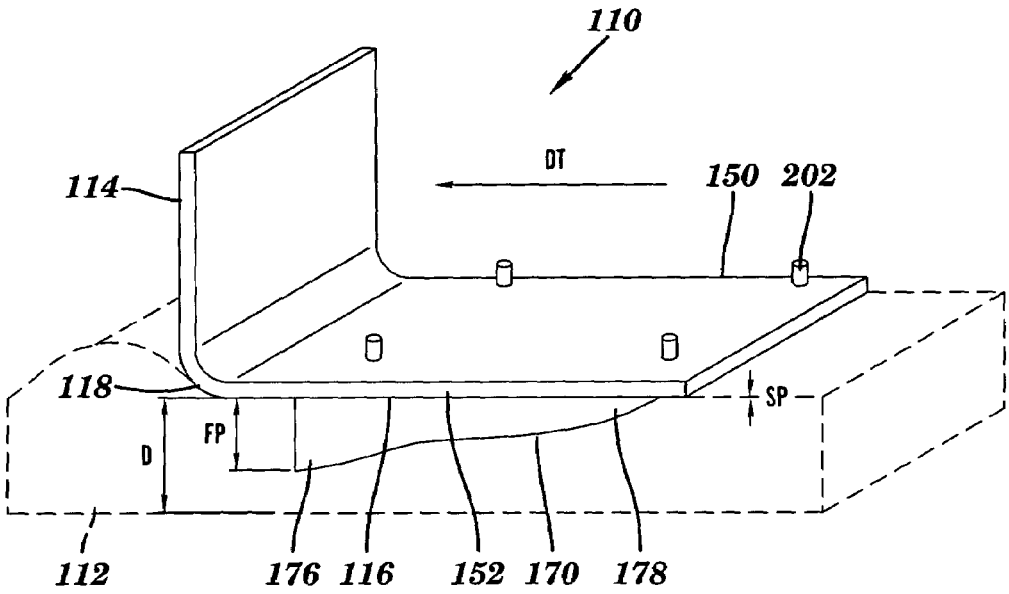
FIG. 3 shows a perspective view of a screed including a material realigning member according to a first embodiment of the invention.
Figure 4:
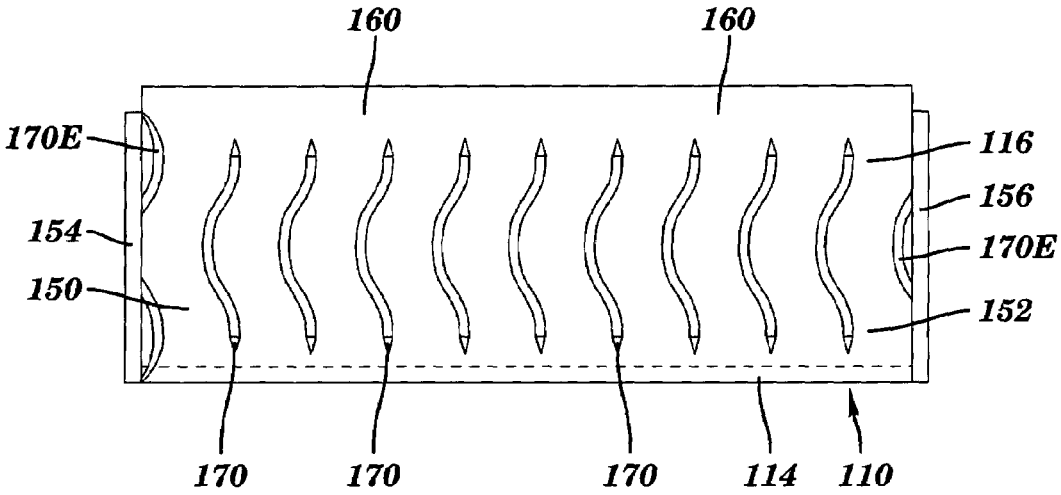
FIG. 4 shows a plan view of the screed of FIG. 3.

Referring to FIGS. 3 and 4, the invention includes a screed 110 for compacting a depth (D) of paving material 112. Screed 110 may include a substantially vertical receiving surface 114, a vertically compacting surface 116 having a first end 150 and a second end 152, and a nose 118 connecting surfaces 114 and 116. Depth D is defined at a position below nose 118. As shown in FIG. 4, screed 110 also may include a first end gate 154 at first end 150 for compacting material in a substantially horizontal direction, and a second end gate 156 at second end 152 for compacting material in a substantially horizontal direction. End gates 154, 156 may be any now known or later developed structure for substantially horizontally compacting a lateral end to a paving material mat.

Figure 1:
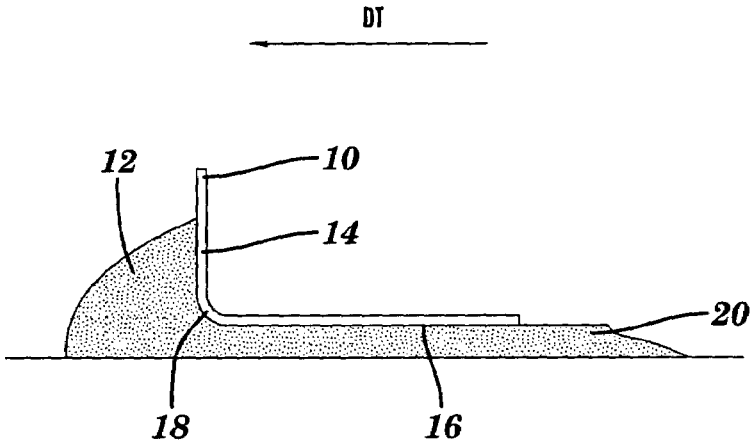
FIG. 1 PRIOR ART
FIG. 1 shows a prior art screed compacting material.
Figure 2:
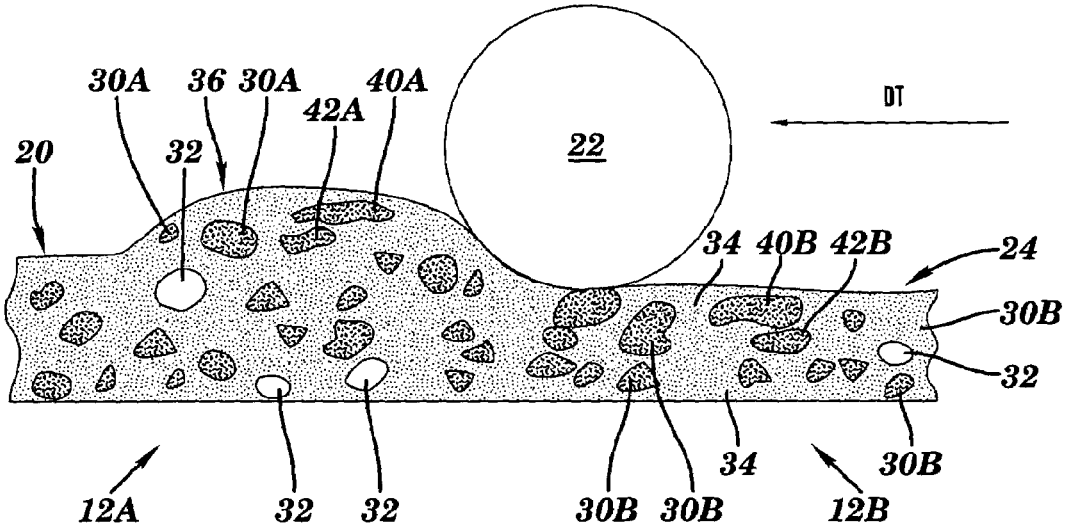
FIG. 2 PRIOR ART
FIG. 2 shows a prior art roller compacting material and a side-by-side comparison of rolled and unrolled material.
Figure 5:
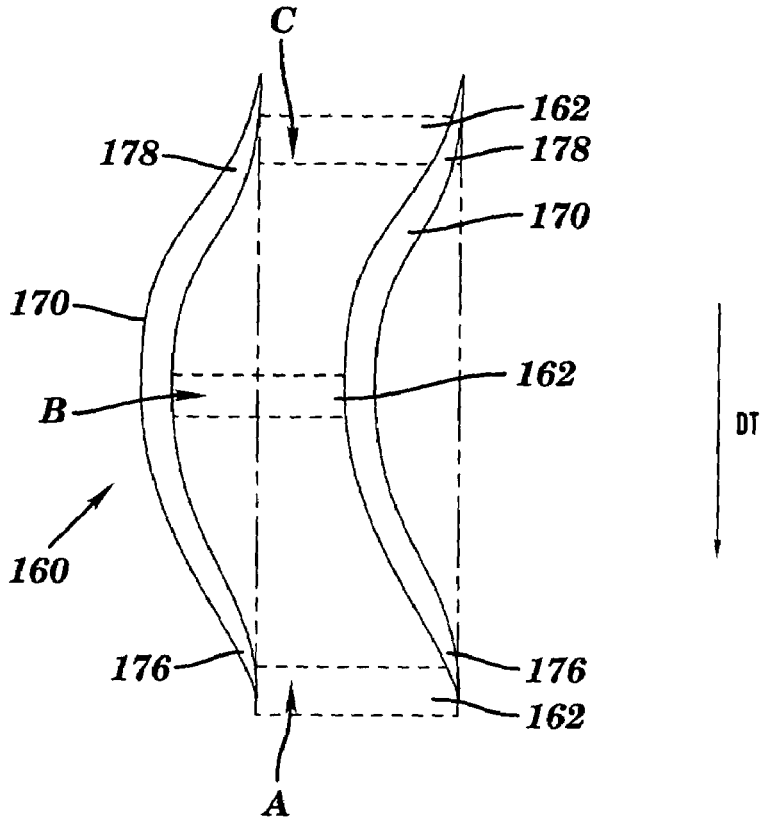
FIG. 5 shows a detail view of a material realigning member in operation.

A material realigning member 160 is provided coupled to screed 110 at a location along vertically compacting surface 116 between first end 150 and second end 152 according to the invention. Referring to FIGS. 3 and 5, material realigning member 160 provides movement of at least a first portion FP (FIG. 3) of depth D of a quantity of material 162 (FIG. 5) laterally, i.e., in a direction substantially perpendicular to a direction of travel DT (FIG. 3), from an initial position (A in FIG. 5 to laterally offset position B) thereof and then at least a second portion SP (FIG. 3) of depth D of quantity of material 162 (FIG. 5) back towards initial position A. It should be recognized that first portion FP and/or second portion SP may include all of depth D in certain circumstances, as will be described below. The two-directional lateral movement of paving material provides further realignment of aggregate particles beyond that provided by nose 118. For example, implementing material realigning member 160 and screed 110 to paving material 12A in prior art FIG. 2, would move aggregate particles 40A, 40B two lateral directions relative to the direction of travel, i.e., into and out of the page. Although a quantity of material 162 is theoretically moved out of its initial lateral position and then back to the same position, the effect on aggregate particles is their realignment relative to one another, i.e., they do not necessarily return to their initial lateral orientation. As a result, aggregate particles that are capable of not overlapping due to a smaller lateral dimension may be moved from the vertical overlap position, thus allowing further compaction.

As shown in FIG. 4, in one embodiment, any number of material realigning members 160 may be grouped for coupling to vertically compacting surface 116 to provide uniform lateral movement of paving material along screed 110. In one embodiment, each material realigning member 160 includes a plurality of elements 170 (i.e., at least two) extending substantially vertically from material compacting screed 110, e.g., vertically compacting surface 116. Material realigning member 160, i.e., elements 170, may be coupled integrally to vertical compacting surface 116, e.g., by welding, as shown in FIGS. 3 and 4, or may be coupled to surface 116 by a mount 172, shown in FIG. 6. Mount 172 includes, for example, a plate 174 for coupling to screed 110, e.g., by bolting or welding, and at least one, and preferably a pair of, element(s) 170 attached thereto, e.g., by welding. Plate 174 may include a beveled edge 176 to prevent drag on paving material passing thereunder.

Figure 6:
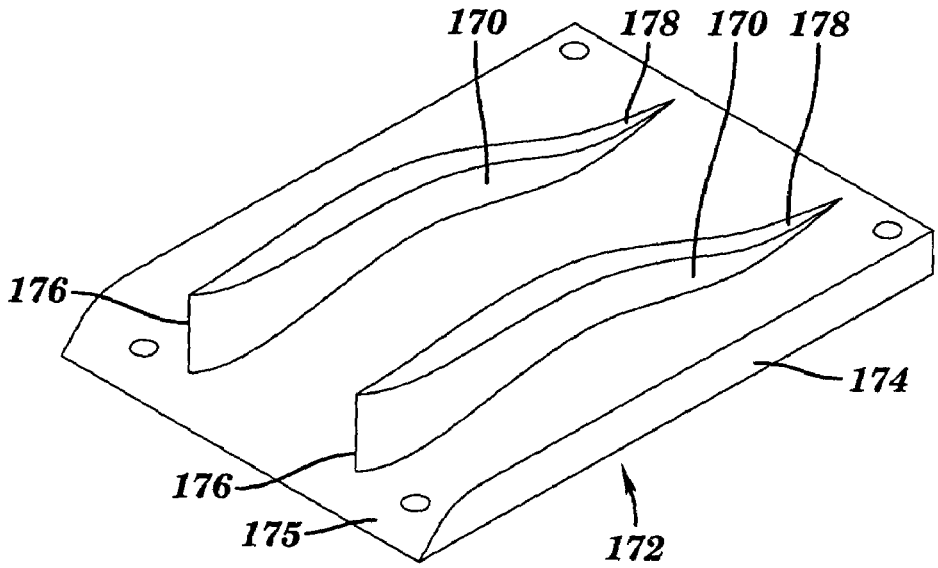
FIG. 6 shows a perspective view of the material realigning member of FIG. 5 coupled to a mount.
Figure 7A:
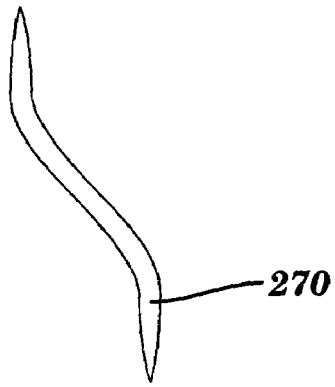
FIGS. 7A–7C show plan view details of alternative embodiments of the material realigning member of FIG. 5.
Figure 7B:
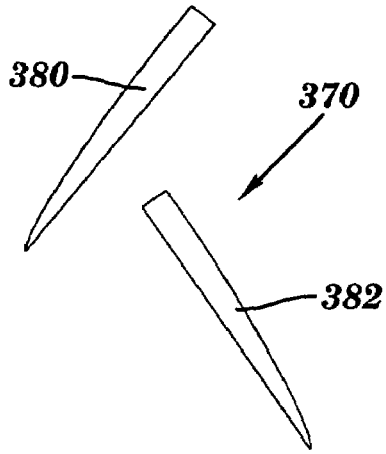
Figure 7C:
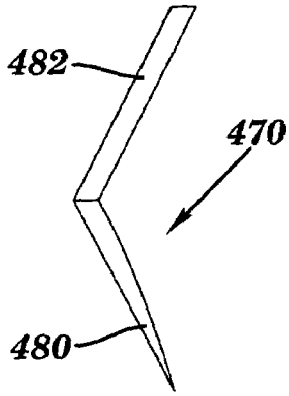

In order to cause paving material movement, each element 170 has a shape to force lateral movement from the initial position and then back towards the initial position. In one embodiment, shown in FIGS. 3–6, element(s) 170 have a curvilinear shape in the form of an elongated C-shape, i.e., a C-shape that has been pulled apart. The degree of lateral offset of element 170 from an end to the most laterally offset point is, in one embodiment, at least 1.5 times the size of the largest aggregate to allow for proper movement. However, other sizes are possible. Referring to FIG. 7A-7C, other illustrative embodiments of element shapes are shown. As shown in FIG. 7A, an element 270 may have an elongated S-shape, i.e., serpentine shape. The degree of lateral offset in either direction of elongated S-shaped element 270 may again be at least 1.5 times the size of the largest aggregate to allow for proper movement. However, other sizes are possible. As shown in FIG. 7B, an element 370 may include a first planar member 380 and a separate second planar member 382 arranged at an angle relative to first planar member 380. As shown in FIG. 7C, an element 470 may include a first planar member 480 and a second connected planar member 482 arranged at an angle relative to first planar member 480. Element 470 in FIG. 7C may also be provided as a single piece of material. For purposes of brevity, only element 170 will be referred to hereinafter.

Returning to FIG. 5, quantity of material 162 is moved by material realigning member 160 laterally from initial position A to a laterally offset position B, and then back towards initial position A, ending at a final position C. Final position C may be completely laterally aligned with initial position A, or may be further left or right, depending on, for example, the amount of lateral movement desired, paving material, etc. In order to completely laterally realign quantity of material 162 with initial position A, material realigning member 160, i.e., each element 170, includes a leading end 176 that is in substantially the same lateral position as a trailing end 178 thereof. As one with skill in the art will recognize, this structure is equally applicable to the other shapes of element(s) shown in FIGS. 7A–7C.

Referring to FIG. 4, the plurality of material realigning members 160 may be positioned equidistantly at locations between first end 150 and second end 152 to provide uniform lateral realignment, or have staggered spacing to provide selective realignment. Spacing between elements 170 should be sufficient to assure that material pushed in one direction may be pushed back. In other words, a quantity of material 162 (FIG. 5) having a known width is substantially maintained as it passes through adjacent elements 170. In one embodiment, a minimum spacing may be determined to be at least 1.5 times a minimum aggregate particle size to assure adequate spacing for material to pass. End gate(s) 154, 156 may also include the shape of an element 170 to assure uniform realignment. That is, at least one end gate 154, 156 may include at least a portion of one of the elements 170E coupled thereto.

Figure 8:
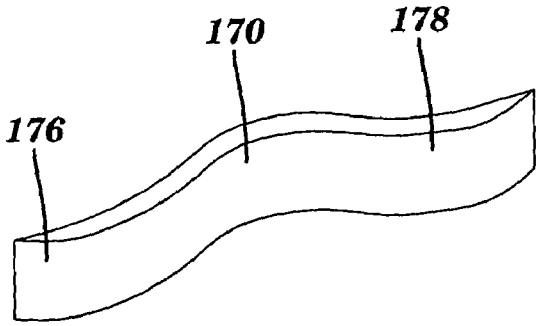
FIG. 8 shows a perspective view detail of another alternative embodiment of the material realigning member of FIG. 5.

With regard to the depth that an element 170 moves material, each element may have a varying height along a length thereof. For example, as shown in FIGS. 3 and 6, each element 170, may decrease in height from a leading end 176 to trailing end 178 such that first portion FP is greater than second portion SP. As shown in FIG. 3, first portion FP may constitute a substantial portion of depth D, while second portion SP constitutes a lesser portion of depth D. In this case, each trailing end 178 diminishes to have no height to ensure no voids are left in paving material extending therefrom. In addition, the varying height assures that paving material at most depths of the mat are moved. As shown in FIG. 5, each element 170 may also have pointed ends 176, 178 to ease penetration of material and to prevent voids. In another embodiment shown in FIG. 8, each element may have a uniform height along a length thereof. That is, leading end 176 and trailing end 178 are substantially equivalent such that first portion FP and second portion SP are substantially equivalent.

The actual dimensions of material realigning member 160, i.e., each element 170, may vary to accommodate different paving material 112 and different paving parameters, e.g., temperature, aggregate size, mat thickness, mix design, etc. In one example, for a loose mat of approximately 2 inches thickness, leading end 176 can be, for example, 1½ inches, and trailing end 178 zero inches. In addition, in one example, each element is approximately 10 inches long to allow for sufficient distance for adequate lateral movement to occur.

Figure 9:
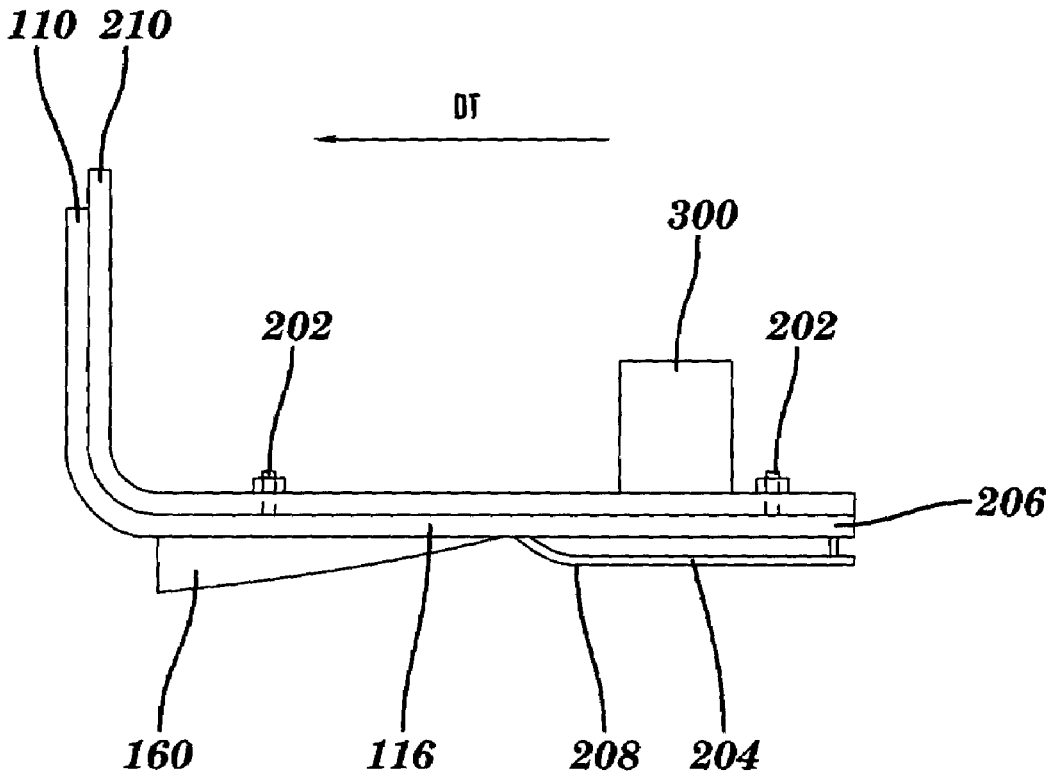
FIG. 9 shows a side view of a screed including a compaction member according to an alternative embodiment of the invention.

Referring to FIG. 9, screed 110 may also includes a coupling 202 for attaching the screed to another screed 210. In this fashion, screed 110 can be used with another screed 210 and then removed when necessary. Coupling 202 may include, for example, welds, clamps, bolts or any other structure sufficient to hold screed 110 to another screed 210. Depending on the screed mounting design, or if additional compaction is desired, an alternative compaction member 204 extending from vertically compacting surface 116 and positioned after material realigning member 160 may be required to compensate for the frontal area of elements 170. Compaction member 204 extends across screed 110 and preferably to a back edge 206 of screed 110. A leading surface 208 of compaction member 204 may be angled, for example, at approximately 30° relative to vertically compacting surface 116. A thickness of compacting member 204 may be determined, for example, to have its total frontal area equal to a maximum frontal area of all elements 170. As another alternative, a vibrator 300 may also be provided for vibrating screed 110 and/or another screed 210 to which screed 110 is coupled. Vibratory motion can be in a vertical direction, a horizontal lateral direction, or both.

Returning to FIG. 3, in operation, the invention provides a method of compacting paving material using a screed having a first end and a second end. In a first step, paving material is compacted in a substantially vertical direction. This step occurs as screed 110 moves forward and paving material 112 is initially compacted at nose 18 of screed 110. As screed 110 proceeds in a forward direction of travel DT, paving material encounters material realigning member(s) 160. At this point, a first portion FP of a depth D of a quantity of the paving material (162 in FIG. 5) is simultaneously moved laterally from an initial position (A in FIG. 5) thereof and then a second portion SP of depth D of quantity of the paving material is moved back towards the initial position. As screed 110 moves forward, paving material 112 is smoothed by the leveling action of vertically compacting surface 116. The additional realignment of material reduces the amount of aggregate particles that are vertically aligned. As a result, the ultimate amount of compaction is increased. Improvement in this process may be accomplished by vibratory motion of screed 110, as described above. It is estimated that a final density of paving material exiting screed 110 may exhibit approximately 93% of a maximum theoretical density.

The invention also includes a method of increasing compaction capability of a screed, the method comprising the steps of: providing a screed having a vertically compacting surface having a first end and a second end; and coupling a material realigning member to the screed at a location along the vertically compacting surface between the first end and the second end for moving a first portion of a depth of a quantity of the paving material laterally from an initial position thereof and at least a second portion of the depth of the quantity of the paving material back towards the initial position.

While this invention has been described in conjunction with the specific embodiments outlined above, it is evident that many alternatives, modifications and variations will be apparent to those skilled in the art. Accordingly, the embodiments of the invention as set forth above are intended to be illustrative, not limiting. Various changes may be made without departing from the spirit and scope of the invention as defined in the following claims.

What is claimed is:

1. A screed for compacting a depth of material, the screed comprising:

a vertically compacting surface having a first end and a second end; and means, extending from the vertically compacting surface between the first end and the second end, for moving at least a first portion of the depth of a quantity of material laterally from an initial position thereof and then at least a second portion of the depth of the quantity of material back towards the initial position.

2. The screed of claim 1, wherein the moving means moves a substantial portion of the depth of the quantity of material laterally from the initial position thereof, and a lesser portion of the depth of quantity of material back towards the initial position.

3. The screed of claim 1, further comprising a first end gate at the first end of the vertically compacting surface for compacting material in a substantially horizontal direction; and a second end gate at the second end of the vertically compacting surface for compacting material in a substantially horizontal direction.

4. The screed of claim 3, further comprising means, positioned on at least one end gate, for moving at least a first portion of the depth of a quantity of material laterally from an initial position thereof and then at least a second portion of the depth of the quantity of material back towards the initial position.

5. The screed of claim 1, further comprising a plurality of moving means positioned along the compacting surface at a plurality of locations between the first end and the second end.

6. The screed of claim 5, wherein the plurality of moving means are positioned equidistantly at locations between the first end and the second end.

7. The screed of claim 1, further comprising means for coupling the screed to another screed.

8. The screed of claim 1, wherein the moving means moves the second portion of the depth of the quantity of material completely back to the initial position.

9. The screed of claim 1, further comprising a compaction member extending from the vertically compacting surface and positioned after the moving means.

10. A material realigning member for use on a material compacting screed having a first end and a second end, the material realigning member comprising:

a plurality of elements, each having a curvilinear shape and extending substantially vertically from a surface of the material compacting screed for moving at least a first portion of a depth of a quantity of material laterally from an initial position thereof and then at least a second portion of the depth of the quantity of material back towards the initial position; and means for coupling the plurality of elements at a location between the first end and the second end.

11. The material realigning member of claim 10, wherein the curvilinear shape includes one of an extended C-shape and an elongated S-shape.

12. The material realigning member of claim 10, wherein each element includes a first planar member and a second planar member arranged at an angle relative to the first planar member.

13. The material realigning member of claim 12, wherein the first planar member and the second planar member are connected.

14. The material realigning member of claim 10, wherein each element has a varying height along a length thereof such that the first portion is greater than the second portion.

15. The material realigning member of claim 10, wherein a leading end of each element has a substantially equivalent height as a trailing end thereof such that the first portion and the second portion are substantially equivalent.

16. The material realigning member of claim 10, wherein a leading end of each element is in substantially the same lateral position as a trailing end thereof.

17. The material realigning member of claim 10, further comprising a compaction member extending from the material compacting screed and positioned after the material realigning member.

18. A material compacting screed comprising: a vertically compacting surface extending between the first end and the second end; and the material realigning member of claim 10.

19. The material compacting screed of claim 18, further comprising a first end gate at the first end for compacting material in a substantially horizontal direction; and a second end gate at the second end for compacting material in a substantially horizontal direction.

20. The material compacting screed of claim 19, further comprising at least a portion of one element coupled to at least one end gate.

21. A method of compacting paving material using a screed having a first end and a second end, the method comprising the steps of:

compacting the paving material in a substantially vertical direction; and simultaneously moving at least a first portion of a depth of a quantity of the paving material under the screed laterally from an initial position thereof and then at least a second portion of the depth of the quantity of the paving material back towards the initial position.

22. The method of claim 21, wherein in the moving step includes compacting the paving material.

23. The method of claim 21, wherein the first portion is greater than the second portion.

24. A method of increasing compaction capability of a screed, the method comprising the steps of:

providing a screed having a vertically compacting surface having a first end and a second end; and coupling a material realigning member to the screed at a location on the vertically compacting surface between the first end and the second end for moving at least a first portion of a depth of a quantity of the paving material laterally from an initial position thereof and at least a second portion of the depth of the quantity of the paving material back towards the initial position.

* * * * *